United States Patent [19]

Hanzawa

[11] Patent Number: 4,577,528

[45] Date of Patent: Mar. 25, 1986

[54] DRIVING/TURNAROUND DEVICE FOR A REMOTE CONTROLLED TOY VEHICLE

[75] Inventor: Tuneo Hanzawa, Tokyo, Japan

[73] Assignee: K. K. Hanzawa Corporation, Tokyo, Japan

[21] Appl. No.: 687,591

[22] Filed: Dec. 31, 1984

[30] Foreign Application Priority Data

Sep. 14, 1984 [JP] Japan ..... 59-140319

[51] Int. Cl.[4] ..... F16H 5/72; A63H 17/36

[52] U.S. Cl. ..... 74/665 GA; 74/810; 74/384; 446/443

[58] Field of Search ..... 74/354, 380, 384, 665 GA, 74/810, 812; 446/443, 460

[56] References Cited

U.S. PATENT DOCUMENTS

| | | | |
|---|---|---|---|
| 2,428,828 | 10/1943 | Berge | 74/812 |
| 3,323,391 | 6/1967 | Chin et al. | 74/812 |
| 3,590,526 | 7/1971 | Deyerl et al. | 446/460 |
| 4,508,516 | 4/1985 | D'Andrade et al. | 446/443 |

FOREIGN PATENT DOCUMENTS

| | | | |
|---|---|---|---|
| 0044148 | 1/1982 | European Pat. Off. | 446/443 |
| 2901087 | 7/1979 | Fed. Rep. of Germany | 74/810 |
| 229883 | 2/1944 | France | 74/812 |
| 2057897 | 4/1981 | United Kingdom | 446/460 |

*Primary Examiner*—Lawrence J. Staab
*Assistant Examiner*—Martin Belisario

[57] ABSTRACT

A driving/turnaround device in use with a remote controlled toy vehicle comprises a reversible motor operable by an external command, an intermediate gear being in mesh with a gear rotated by the motor, a pair of axles being independently provided for right and left driving wheels, the intermediate gear being in mesh with a gear for transmitting a drive force to one of the axles, a rectilinear movement gear and a turnaround reduction gear being in mesh with a gear for transmitting a drive force to the other of the axles, a swing member rotatably mounted to the car body being provided with a pair of switch gears meshing with each other, the swing member being swung so that one of the pair of the switch gears meshes with the intermediate gear, while the other is in mesh with the rectilinear movement gear in the forward rotation, and is meshed with the reduction gear in the reverse rotation.

1 Claim, 4 Drawing Figures

DRIVING/TURNAROUND DEVICE FOR A REMOTE CONTROLLED TOY VEHICLE

BACKGROUND OF THE INVENTION

1. Field of the Invention

The present invention relates to a driving/turnaround device for a toy vehicle remotely controlled in a wire or wireless manner.

2. Prior Art

Various types of driving/turnaround devices in use with the toy vehicle have been known. One of the conventional these devices is disclosed in Japanese Patent Publication No. 57-28595. In this device, two right and left drive motors are used. Another conventional device uses the electromagnet in addition to the drive motor, as disclosed in Japanese Patent Publication No. 55-41793. In a further conventional driving/turnaround device as disclosed in Japanese Utility Model Publication No. 56-2295, a single reversible motor is used. In a forward mode, the toy vehicle rectilinearly advances. At the time of switching from the forward mode to the backward mode, a swing member is swung due to the inertia generated. The swing member couples the right and left steering wheels, which are different from the right and left driving wheels. In a backward mode, the toy vehicle is turned around.

The above-mentioned conventional devices of the two types, one using two motor, and the other using the motors and the electromagnet, are expensive. Further, weight of the driving source is heavy. In the conventional device of Japanese Utility Model No. 56-22951 in which the right and left wheels for steering are coupled by the swing member, a link mechanism is required for transmitting a drive force from the motor to the swing member. Therefore, its structure is complicated, and it is difficult to obtain a stable turnaround of the toy vehicle.

SUMMARY OF THE INVENTION

Accordingly, an object of the present invention is to provide a driving/turnaround device in use with a remote controlled toy vehicle which can make a rectilinear movement, an advance, a turnaround, and a backward movement of the toy vehicle by means of a single motor, and further can realize a stable turnaround with a relatively simple structure.

To achieve the above object, there is provided a driving/turnaround device in use with a remote controlled toy vehicle comprising: a reversible motor rotatable in a forward direction or a backward direction in response to a command applied from a remote controller; an intermediate gear being in mesh with a gear rotated by the motor; a pair of ailes being independently provided for right and left driving wheels, and rotatably supported by a car body; the intermediate gear being in mesh with a gear for transmitting a drive force to one of the axles; a rectilinear movement gear like the intermediate gear and a turnaround reduction gear being in mesh with a gear for transmitting a drive force to the other of the axles; a swing member rotatably mounted to the car body being provided with a pair of switch gears meshing with each other, the swing member being swung so that one of the pair of the switch gears meshes with the intermediate gear, while the other is in mesh with the rectilinear movement gear in the forward rotation, and is meshed with the reduction gear in the reverse rotation.

In operation, when the motor is forwardly rotated by a command from the remote controller, the intermediate gear forwardly rotates through a drive gear. A drive force is transmitted to one of the right and left driving wheels, through a route of a gear meshing with the intermediate gear and an axle. At the same time, the drive force is transmitted to a rectilinear movement gear like the intermediate gear, through a pair of switch gears from the intermediate gear. The drive force is further transmitted to the other of the right and left driving wheels, through a gear meshing with the rectilinear movement gear and an axle. As a result, the right and left driving wheels rotate at the equal speeds, so that the toy vehicle rectilinearly advances. When the motor is reversely rotated, a drive force is transmitted from the intermediate gear to one of the right and left driving wheels. As a result, a rotating force, which is equal to that in the advance, but has the direction to move the toy vehicle backwardly. The drive force in the reverse direction transmitted from the intermediate gear to one of the switch gears causes the swing member to swing. The other of the switch gears is detached from the rectilinear movement gear to be in mesh with the reduction gear. The rotating force with the backward direction as reduced by the reduction gear is transmitted to the other of the right and left driving wheels. Thus, when the motor reversely rotates, there is a difference of the rotating speed between the driving wheels. As a result, the toy vehicle turns and moves back. When the motor is forwardly rotated again, the swing member returns to the original position, so that a drive force is transmitted from the intermediate gear through the pair of the switch gears, to the rectilinear movement gear, and the toy vehicle rectilinearly advances. As described above, in the present invention, the swing member is swung, according to the forward or the reverse rotation of the motor, to cause the switch gears of the swing member to be in mesh with the rectilinear movement gear. A rotating speed difference as defined by a ratio of the numbers of teeth of the rectilinear movement gear and the reduction gear, is applied to the right and left driving wheels when the motor is rotated in the reverse direction. Therefore, the toy vehicle can be turned around by a single motor. Thus, the driving/turnaround device according to the present invention takes a simple structure that the swing member, a pair of the switch gears, and the reduction gear are assembled into the drive section. With such a simple structure, even when the voltage applied from a power source such as a battery to the motor, drops, the toy vehicle can stably be turned around with the turning radius substantially equal to that when the power voltage is at normal level.

BRIEF DESCRIPTION OF THE DRAWINGS

Other features, advantages and objects will be apparent from the following description in connection with the accompanying drawings, in which.

DETAILED DESCRIPTION OF THE PREFERRED EMBODIMENT

A preferred embodiment of a driving/turnaround device according to the present invention will be described referring to FIG. 1.

Before proceeding with description, it will expressly be understood that words to indicate directions, relative positions, etc. are used with relation to only the accompanying drawings.

Figure 1:
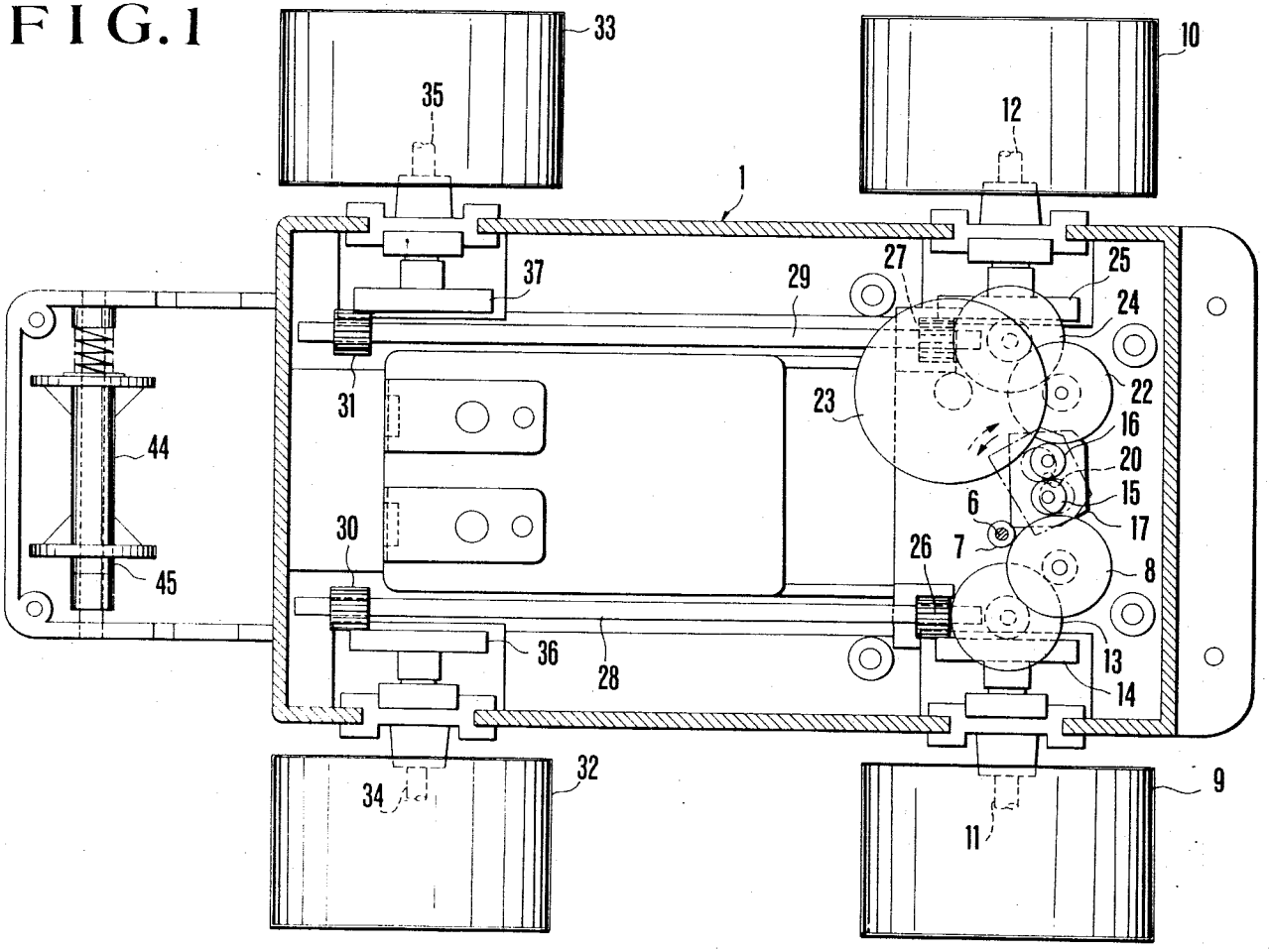
FIG. 1 shows a plan view of an embodiment of a driving/turnaround device according to the present invention.
Figure 2:
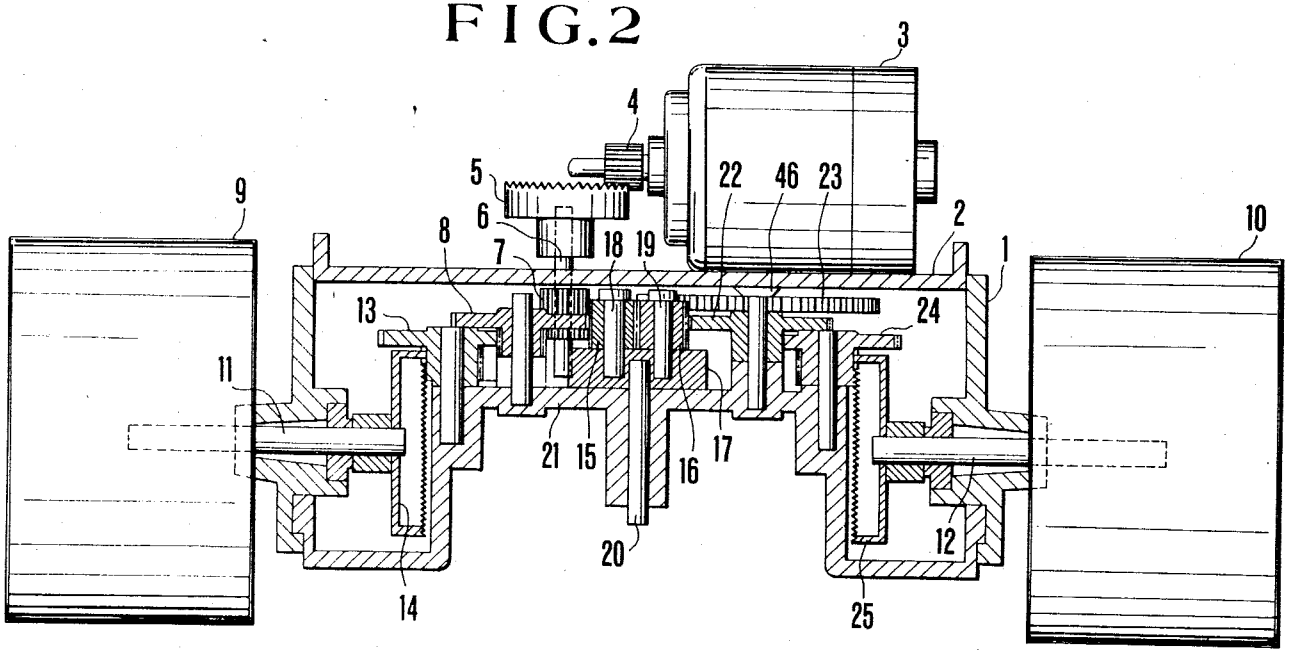
FIG. 2 shows a cross sectional view of a drive section of the driving/turnaround device shown in FIG. 1.
Figure 4:
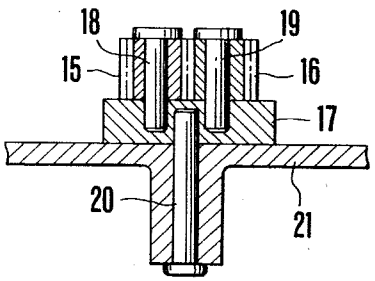
FIG. 4 shows a cross sectional view of a swing member with switch gears, which is provided in the drive section in the driving/turnaround device shown in FIG. 1.
Figure 3:
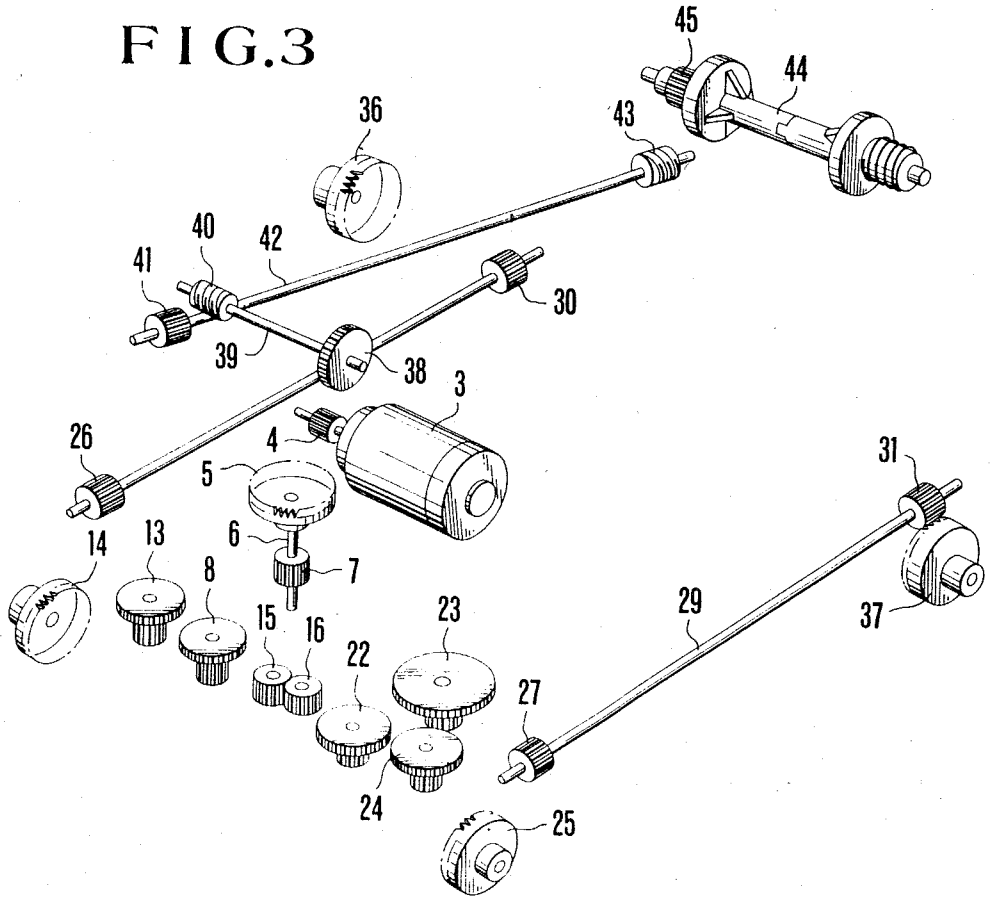
FIG. 3 shows an exploded view illustrating a drive mechanism of the driving/turnaround device of FIG. 1.

In FIGS. 1 through 3, a car body 1 of a four wheel drive toy vehicle has a support table 2 on the rear side. On the support table 2, a motor 3 is set in a liftable manner. The motor 3 rotates in the forward direction or the backward direction according to a command issued from a remote controller of the wire control type (not shown). A gear 4 fixed to a rotating shaft of the motor 3 is engaged with a crown gear 5. A vertical shaft 6 fixed to the crown gear 5 is rotatably supported by the support table 2, while extending under the support table 2. A driving gear 7 is fixed to the lower end of the vertical shaft 6. A large gear of an intermediate gear 8 is engaged with the driving gear 7. Axles 11 and 12 of right and left driving wheels 10 and 9 as rear wheels are independently provided and rotatably mounted to the car body 1. A large gear of a gear 13 for transmitting a drive force to the axle 11 of the left driving wheel 9 is in mesh with a small gear of the intermediate gear 8. A small gear of the gear 13 is in mesh with a crown gear 14 fixed to the inner side end of the axle 11. The small gear of the intermediate gear 8 is in mesh with one of a pair of switch gears 15 and 16 which mesh with each other. The switch gears 15 and 16 are rotatably fitted to vertical shafts 18 and 19 planted in the swing member 17, respectively. The swing member 17 is horizontally and rotatably mounted to a gear support 21 by means of a shaft 20. The gear support 21 is located under the support table 2, and fixed to the car body 1. The other of the paired gears 15 and 16 is selectively engaged with either of a large gear of a rectilinear movement gear 22 like the intermediate gear 8 or a large gear of the reduction gear 23 for turnaround. The large gear of the rectilinear movement gear 22 is larger in diameter and in the number of teeth than the large gear of the rectilinear movement gear 22. A small gear of the rectilinear movement gear 22 and a small gear of the reduction gear 23 are in mesh with a large gear of a gear 24 for transmitting a drive force to the axle 12 of the right driving wheel 10. A crown gear 25 fixed to the inner side end of the axle 12 meshes with a small gear of the gear 24. Incidentally, the intermediate gear 8, the gear 13, the rectilinear movement gear 22, the reduction gear 23 and the gear 24 are rotatably mounted to the gear support 21 by means of the vertical axes. Rear interlocking gears 26 and 27 respectively come into contact with the crown gears 14 and 25 fixed to the axles 11 and 12 of the driving wheels 9 and 10 as the rear wheels. The interlocking shafts 28 and 29, which are respectively fixed at the rear ends to the rear interlocking gears 26 and 27, are rotatably supported by the car body 1. The interlocking shafts 28 and 29 extend forwardly to securely be coupled at the fore ends to front interlocking gears 30 and 31, respectively. Axles 34 and 35 of driving wheels 32 and 33 as the front wheels are independently provided and rotatably supported by the car body 1. Crown gears 36 and 37 fixed to the axles 34 and 35 are engaged with the front interlocking gears 30 and 31, respectively. As shown in FIG. 3, a working gear 38 for a working machine such as a toy wrench is fixed to one end of a power transmission shaft 39. The working gear 38 meshes with the gear 4 fixed to the rotating shaft of the motor 3 only when the motor 3 is lifted. The power transmission shaft 39 horizontally extends. A gear 40 fixed to the other end of the power transmission shaft 39 comes into working contact with a gear 41. A gear 43 securely connected to the fore end of an operation shaft 42 is in mesh with a gear 45 of a rotary member 44 of an appropriate working machine. The power transmission shaft 39, the operation shaft 42 and the rotary member 44 are rotatably mounted to the car body 1. A spring 46, which is inserted between the support table 2 and the reduction gear 23, prevents the reduction gear 23 from floating from its proper position, thereby to secure its reliable working contact with the switch gear 16.

The operation of a driving/turnaround device thus constructed will now be described.

To start, a remote controller is operated to issue a forward command to the motor 3. Then, the motor 3 is forwardly driven to rotate its rotating shaft. The rotating force of the motor 3 is transmitted from the rotating shaft to the intermediate gear 8, through a route of the gear 4 - crown gear 5 - vertical shaft 6 - driving gear 7. Upon receipt of the rotating force, the intermediate gear 8 forwardly rotates. The forward rotation of the intermediate gear 8 is transmitted, through a route of the intermediate gear 8 - gear 13 - crown gear 14 - axle 11, to the left driving wheel 9. Then, the left driving wheel 9 forwardly rotates. At the same time, the forward rotation of the intermediate gear 8 is transmitted to the right driving wheel 10, through a route of the intermediate gear 8 - switch gear 15 - switch gear 16 - rectilinear forward movement gear 22 - gear 24 - crown gear 25 - axle 12. The right driving wheel 10 rotates at an equal speed to that of the left driving wheel 9. Further, the driving wheels 32 and 33 also are respectively driven through a route of the crown gears 5 and 25 - rear interlocking gears 26 and 27 - interlocking shafts 28 and 29 - front interlocking gears 30 and 31 -crown gears 36 and 37 - axles 34 and 35. The driving wheels 32 and 33 forwardly rotate at the equal speed as the driving wheels 9 and 10. Therefore, the toy vehicle runs rectilinearly and forwardly, with four-wheel drive.

In the forward movement, the remote controller is operated to change the command from the forward command to the reverse command or to temporarily stop the vehicle and then to give the reverse command. By such an operation of the remote controller, the motor 3 is reversely driven to rotate the intermediate gear 8 through the same route as that of the forward rotation. As a result, the left driving wheel 9 also reversely rotates. With the reverse rotation of the intermediate gear 8, the switch gear 15 also reversely rotates. At this time, the swing member 17 is swung in the direction of an arrow of a continuous line shown in FIG. 1 about the shaft 20 by the reverse rotating drive force, since the switch gears 15 and 16 are rotatably mounted to the gear support 21 by the shaft 20, through the swing member 17. With the swing of the swing member 17, the switch gear 16 departs from the rectilinear movement gear 22, and meshes with a large gear of the reduction gear 23 with a larger number of teeth than that of the rectilinear forward movement gear 22.

Therefore, the right driving wheel 10 reversely rotates through the route of the intermediate gear 8 - switch gear 15 - switch gear 16 - reduction gear 23 - gear 24 - crown gear 25 - axle 12. Then, the left driving wheel 9 reversely rotates at the equal speed to that at the forward rotation. The right driving wheel 10 reversely rotates at a lower speed than that at the forward rotation. In this case, the driving wheels 32 and 33 as the front wheels reversely rotate through the same route as that at the forward rotation. Under this condition, the left driving wheel 9 and the left driving wheel 32 have the equal speeds, while the right driving wheel 10 and the right driving wheel 33 have the equal speeds but lower than those of the left driving wheel 9 and the left driving wheel 32. As a result, the toy vehicle turns to the right and goes backwardly.

Then, if the remote controller is operated to give a forward command to the motor 3, a forward rotating drive force is transmitted from the intermediate gear 8 to the swing member 17. With the forward rotating drive force, the swing member 17 turns in the direction of an arrow shown by a chain line in FIG. 1. The switch gear 16 depart from the reduction gear 23 to mesh with the rectilinear forward movement gear 22. As a result, the toy vehicle rectilinearly advances, as mentioned above.

When the toy vehicle is running, the motor 3 is in the lowering state. Accordingly, the gear 4 mounted to the rotating shaft of the motor 3 is being detached from the gear 38, and the working machine will not operate.

When the toy vehicle stops, if the motor 3 is lifted by a manual operation, for example, the gear 4 of its rotating shaft is detached from the crown gear 5 and is in mesh with the working gear 38. Under this condition, if the motor 3 is rotated forwardly or reversely, a rotating drive force by the motor 3 is transmitted to the rotary member 44 of the working machine, through a route of the rotary shaft of the motor 3 - working gear 38 - power transmission shaft 39 - gear 40 - gear - operation gear 42 - gear 43 - gear 45. Then, the gear 45 performs a desired work, viz. lifting of an article, by a winch as the working machine.

To limit a swing range of the swing member 17, it is preferable to mount a stopper or stoppers on the gear support, for example, of the car body. Alternatively, either the front wheels or the rear wheels, not both the front and the rear wheels, may be used as the driving wheels. The remote controller is not limited to the wire control type, but may be a wireless control type in which a transmitter is contained in an operating box and a receiver is carried on the car body. A power source for the motor is preferably carried on the car body. The mechanism to operate the working maching is not essential to the present invention and therefore is omissible, if necessary.

As described above, in the present invention, the intermediate gear is provided. When the motor rotates forwardly or backwardly, the intermediate gear rotates in the same direction as the motor. By use of the intermediate gear, one of the right and left driving gears is rotated at the equal speed in both the forward and the reverse rotations. The other is rotated at the equal speed as the one driving wheel in the forward rotation, but is rotated at a reduced speed in the reverse rotation. With such a structural arrangement, the toy vehicle can be rectilinearly and forwardly moved in the forward direction of the motor. The toy vehicle can be turned around and moved backwardly in the reverse direction. To effect the operation, the swing member is provided, which has a pair of switch gears meshing with each other. The swing member is swung by the forward and reverse rotation of the intermediate gear. In the forward rotation, the rotating force is transmitted from the intermediate gear to the rectilinear forward movement gear, through the pair of the switch gears. Then, the right and left driving wheels are rotated at the equal speed. In the reverse rotation, the rotating force is transmitted from the intermediate gear 8 to the reduction gear for turning about the toy vehicle. In this way, one of the driving wheel is rotated at a lower speed than the other, to cause a difference rotating speed between both the driving wheels. By the speed difference, the toy vehicle is switched in its direction and moves backwardly. A drive force generated when the intermediate gear meshes with the switch gears is used for the swinging of the intermediate gear. Therefore, only one motor is required for the driving force. In this respect, the toy vehicle is extremely simplified in structure and reduced in cost. These features are distinguished particularly when comparing with the toy vehicle of the type in which the right and left steering wheels are coupled with a swing member and a drive force is transmitted to the swing member. Further, a gear ratio between the intermediate gear 8 and the rectilinear movement gear, and the reduction gear, provides a speed difference between the right and left driving wheels when the toy vehicle turns around. Because of this feature, the toy vehicle can stably be turned with a uniform turning radius at all the times, even when the power voltage of a battery, for example, drops below a normal level. Further, also in the speed reduction mode, the required torque for the motor is equal to that in the normal mode. Further, the driving system can easily be modified into a four-wheel driving system.

What is claimed is:

1. A driving/turnaround device in use with a remote controlled toy vehicle comprising:

a reversible motor rotatable in a forward direction or a backward direction in response to a command applied from a remote controller;

an intermediate gear being in mesh with a gear rotated by said motor;

a pair of axles being independently provided for right and left driving wheels, and rotatably supported by a car body;

said intermediate gear being in mesh with a gear for transmitting a drive force to one of said axles;

a rectilinear movement gear like said intermediate gear and a turnaround reduction gear being in mesh with a gear for transmitting a drive force to the other of said axles;

a swing member rotatably mounted to said car body being provided with a pair of switch gears meshing with each other, said swing member being swung so that one of the pair of said switch gears meshes with said intermediate gear, while the other is in mesh with said rectilinear movement gear in the forward rotation, and is meshed with said reduction gear in the reverse rotation.

* * * * *